US007866103B2

(12) United States Patent
Marschke

(10) Patent No.: US 7,866,103 B2
(45) Date of Patent: Jan. 11, 2011

(54) BUILDING WALL PANELS OF HOLLOW CORE CONSTRUCTION

(76) Inventor: Carl R. Marschke, N9955 Memory La., Phillips, WI (US) 54555

( * ) Notice: Subject to any disclaimer, the term of this patent is extended or adjusted under 35 U.S.C. 154(b) by 245 days.

(21) Appl. No.: 12/187,658

(22) Filed: Aug. 7, 2008

(65) Prior Publication Data

US 2009/0038259 A1 Feb. 12, 2009

Related U.S. Application Data

(63) Continuation-in-part of application No. 11/835,516, filed on Aug. 8, 2007.

(51) Int. Cl.
*E04C 1/00* (2006.01)

(52) U.S. Cl. ..... 52/309.4; 52/309.1; 181/287

(58) Field of Classification Search ..... 52/309.4, 52/309.1, 309.7, 309.13, 309.15; 181/287, 181/290, 291, 295, 296, 286
See application file for complete search history.

(56) References Cited

U.S. PATENT DOCUMENTS 4,989,688 A 2/1991 Nelson et al.

FOREIGN PATENT DOCUMENTS

| | | |
|---|---|---|
| JP | 9-100600 | 4/1997 |
| JP | 9100600 | 4/1997 |
| JP | 2003-253854 | 9/2003 |
| JP | 2003253854 | 9/2003 |
| KR | 20-386579 | 6/2005 |
| KR | 20-0386579 | 6/2005 |
| KR | 10-2006-0001929 | 1/2006 |
| KR | 1020060001929 | 1/2006 |
| WO | 2006109932 | 10/2006 |

OTHER PUBLICATIONS

International Search Report dated Nov. 11, 2008.
Patent Abstracts of Japan; Publication No. 2003-253854; Wall Panel for Bath Unit; Publication Date Oct. 9, 2003.
Hollow Sheet Panel and Partition Wall Panel and the Like Using the Same; Patent No. JP9100600(A); Publication Dated: Apr. 15, 1997.
Korean Patent Abstract for Publication No. 1020060001929.
International Search Report mailed Nov. 12, 2008.
English translation Abstract of JP9100600.
English translation Abstract of JP2003253854.
English translation Abstract of KR 1020060001929.
English translation Abstract of KR 20050052969.

*Primary Examiner*—Richard E Chilcot, Jr.
*Assistant Examiner*—Mark R Wendell
(74) *Attorney, Agent, or Firm*—Andrus, Sceales, Starke & Sawall, LLP

(57) ABSTRACT

Building wall panels having lightweight hollow core interiors include embodiments suitable for interior and exterior walls, for industrial, commercial or residential buildings, and for multi-story structures. Various methods for making these wall panels are disclosed, including the formation of cast gypsum firewall layers.

12 Claims, 12 Drawing Sheets

BUILDING WALL PANELS OF HOLLOW CORE CONSTRUCTION

RELATED APPLICATION

This is a continuation-in-part of application Ser. No. 11/835,516, filed Aug. 8, 2007.

BACKGROUND OF THE INVENTION

The present invention pertains to lightweight structural wall panels for buildings and, more particularly, to such panels having a hollow core interior construction that may be adapted for use in industrial, commercial and residential building structures.

The potential for the use of hollow core elements in the construction of buildings and other structures has been known for many years. Hollow cores of corrugated or honeycomb paper or metal sheet material, enclosed by upper and lower skin panels or sheets, have long been used or proposed for use as floor, wall and roof panels for buildings. However, the use of such hollow core panels has been inhibited because of difficulties in fabricating the panels in an efficient and cost effective manner.

In my co-pending patent application Ser. No. 11/476,474, entitled "Method and Apparatus for Manufacturing Open Core Elements from Web Material", filed Jun. 28, 2006, and Ser. No. 11/769,879, bearing the same title and filed Jun. 28, 2007, both of which applications are incorporated by reference herein, there are disclosed systems and techniques for manufacturing hollow core panels of widely varying dimensions using corrugating techniques and a unique lay-up process. Those systems and techniques are applied to make building wall panels of diverse constructions.

In addition, the building wall panels described herein are useful in the construction of buildings utilizing floor and roof constructions described in my co-pending patent application Ser. Nos. 11/485,823, entitled "Hollow Core Floor and Deck Element", filed Jul. 13, 2006, and Ser. No. 11/777,002, bearing the same title and filed on Jul. 12, 2007, which applications are also incorporated by reference herein.

SUMMARY OF THE INVENTION

In a basic embodiment of the present invention, a building wall panel is provided that includes a rectangular peripheral outer frame having vertical edge frame members and upper and lower horizontal edge frame members joined to the ends of the vertical edge frame members, the frame enclosing an open core element that is defined by a plurality of fluted strips of a web material bonded together by interposed smooth unfluted webs, said open core element having the smooth webs horizontally disposed in use and the flutes oriented perpendicular to the plane of the frame to define with the frame parallel inner and outer panel faces. The frame and at least a portion of the open core element are filled with a closed cell foam. A skin sheet is attached to and covers the inner face of the panel, and an outer layer is attached to and covers the outer face of the panel. The skin sheet preferably comprises a two-layer composite including an inner impervious layer and an outer paper layer. The outer layer may comprise any of several materials used as exterior wall panels, including plywood, oriented strand board, plastic, and steel. In a particularly preferred embodiment, a portion of the open core element is filled, within the frame, with a layer of gypsum.

In one embodiment of the invention, suited particularly to forming the external wall of a commercial or industrial building, a wall panel comprises a rectangular peripheral outer frame that includes vertical edge frame members and upper and lower horizontal edge frame members that are joined to the ends of the vertical edge frame members. The frame encloses an open core element made from a plurality of fluted strips of a web material that are bonded together and have flutes oriented perpendicular to the plane of the frame to define, with the frame, parallel inner and outer panel faces. Closed cell foam fills at least a portion of the open core element. An inner steel skin sheet is attached to and covers the inner panel face. An intermediate steel skin sheet is disposed between and lies parallel to the inner and outer panel faces. The intermediate steel skin sheet is attached at its peripheral edge to the frame and divides the open core element into inner and outer core elements. An outer layer is attached to and covers the outer panel face.

The rectangular peripheral frame is preferably made of wood and comprises two-piece vertical edge frame members and two-piece horizontal edge frame members. The intermediate steel skin sheet is sandwiched between and attached to the two-piece vertical and horizontal edge frame members. The wall panel also includes interior wood frame members that extend between and are attached to the vertical edge frame members. The interior frame members lie parallel to the horizontal edge frame members. The interior wood frame members are attached to one piece of the two-piece frame members and positioned on one side of the intermediate skin sheet. Preferably, the interior wood frame members extend laterally and horizontally between the intermediate skin sheet and the inner skin sheet. The outer core element is filled with closed cell foam.

In a preferred embodiment, the open core element includes smooth webs that are interposed between and bonded to the flute tips of adjacent fluted strips. The core element is oriented with the smooth webs horizontally disposed. The web material preferably comprises paper and the paper web is treated to make it waterproof. The outer panel cover layer could be made of a number of different materials, including steel, wood, plywood, oriented strand board, particle board and plastic.

The interior wood frame members provide for the attachment of floor and roof supports to the wall panel. The supports are attached to the inner skin sheet with fasteners that extend through the interior skin sheet, the interior wood frame member and the inner or front steel skin sheet. The floor and roof supports typically comprise steel angle sections.

In another embodiment, suited particularly to residential building construction, the building wall panel has a peripheral frame that encloses an open core element having a plurality of fluted strips of a web material bonded together with the flutes oriented perpendicular to the plane of the frame and defining therewith parallel opposite faces. A continuous layer of gypsum inside the frame fills a portion of the open core element adjacent one panel face. The first skin sheet covers the face adjacent the gypsum layer and a second skin sheet covers the other panel face. The gypsum layer is formed flush with the panel face and the first skin sheet includes a vapor barrier sheet that covers the gypsum layer and a paper sheet covering the vapor barrier sheet. The remainder of the open core element may be filled with a closed cell foam. The second skin sheet comprises a substrate layer that is bonded to the foam filled core element. The substrate layer may be made of plywood, oriented strand board, particle board or the like.

In an embodiment particularly suited to outer wall construction, a layer of concrete forms a continuous layer inside the frame and fills a portion of the open core element. The layer of concrete is placed flush with the inner face of the panel and is covered by the first skin sheet. A gypsum layer is positioned inside and covers the inside surface of the concrete layer. The remainder of the open core element may be filled with a closed cell foam. Preferably, the open core element includes smooth unfluted webs that are interposed between and are bonded to the flute tips of adjacent fluted strips, and the core element is oriented with the smooth unfluted webs horizontally disposed.

When used an interior wall panel, the gypsum layer lies flush with the face in which it is formed and is covered by the first skin sheet. The panel includes another gypsum layer inside the frame, flush with the other face and filling another portion of the open core element.

One method for making a building wall panel, in accordance with the present invention, comprises the steps of (1) forming a hollow core element from strips of a fluted web material and bonding the strips together to form a rectangular core panel having parallel front and rear faces with the flutes oriented perpendicular to the faces, (2) providing an enclosing peripheral frame for the core panel, (3) supporting the frame on a horizontal surface, (4) filling the frame to a selected depth with a liquid gypsum mixture, (5) pressing one face of the core panel into the frame and through the liquid gypsum to the supporting surface and forcing the gypsum into the open core panel to the selected depth, and (6) allowing the liquid gypsum to set sufficiently to form a self-supporting gypsum layer.

The foregoing method also preferably includes the steps of (1) attaching a paper cover sheet to the face of the frame supported on the horizontal surface before filling, and (2) causing the liquid gypsum to cover the surface of the sheet and to bond thereto after setting. The method may also include the step of providing the inside face of the cover sheet with a barrier layer that is impervious to moisture.

Another variant of the method of the present invention comprises the steps of (1) filling the frame to a selected depth with a liquid concrete mixture before the liquid gypsum filling step, (2) filling the frame atop the liquid concrete to the selected depth with said liquid gypsum mixture, (3) continuing the pressing step through the liquid gypsum to press the core panel face through the liquid concrete to the supporting surface and (4) allowing the liquid concrete to set sufficiently to form a self-supporting layer joined to the self-supporting gypsum layer.

Another embodiment of a method of the subject invention for making a building panel comprises the steps of (1) forming a hollow core element from strips of a fluted web material that are bonded together to form a rectangular core panel. The core panel has a front face and a rear face with the flutes of the web material oriented perpendicular to the faces, (2) enclosing the core panel in a peripheral frame, (3) pressing one face of the framed core panel into a liquid gypsum mixture and forcing the liquid gypsum into a portion of the hollow core element on one face of the panel, and (4) allowing the liquid gypsum to set sufficiently to form a self-supporting gypsum layer.

The method also preferably includes the step of applying a paper cover sheet to the front face of the panel. The front face of the core panel and the gypsum layer are preferably formed coplanar with a front face of the frame and the paper cover sheet covers the front face of the frame.

The method may also include the steps of (1) inverting the frame, (2) pressing the other face of the frame core panel into the liquid gypsum mixture and forcing the liquid gypsum into a portion of the hollow core element at the other face, and (3) allowing the liquid gypsum in the other face portion of the panel to dry sufficiently to form a self-supporting gypsum layer.

In certain applications, the basic wall panel of the present invention may have to be modified to add vertical load bearing strength. If the wall panel includes openings for doors, windows and the like, the reduction in load bearing strength can be overcome by the addition of a plurality of reinforcing strips that are attached to the outer panel layer and extend vertically between the upper and lower edge frame members. The strips are placed atop and secured to one another and, preferably, positioned laterally adjacent the openings. In a multi-story panel, the panel is provided with a plurality of reinforcing strips placed over one another with a first of the strips attached directly to the outer layer and extending from a lower end to the upper edge frame member. Each subsequently attached strip has a length less than the strip that precedes it and, preferably, the strips are sequentially shortened in length by about the height of one building story.

The modified panels may otherwise be constructed generally in accordance with the basic assembly described above. The strips are preferably made of steel sheet material and may have a thickness in the range of about 0.040 to 0.080 inch. The strips may be of the same width or each subsequently attached and incrementally shortened strip may have a width less than the strip that precedes it.

In a further embodiment of the present invention, the exterior building wall panel is similar to that described above. However, the inner core element, positioned between the interior steel skin sheet and the intermediate steel skin sheet, is filled with a dry sand layer to provide an increased mass and to provide a sound-deadening barrier. Preferably, the entire inner core element is filled with the dry sand.

The outer core element, between the intermediate skin sheet and the outer layer, may be filled with a closed cell foam, in a manner described with respect to previous embodiments.

DETAILED DESCRIPTION OF THE PREFERRED EMBODIMENTS

Figure 1:
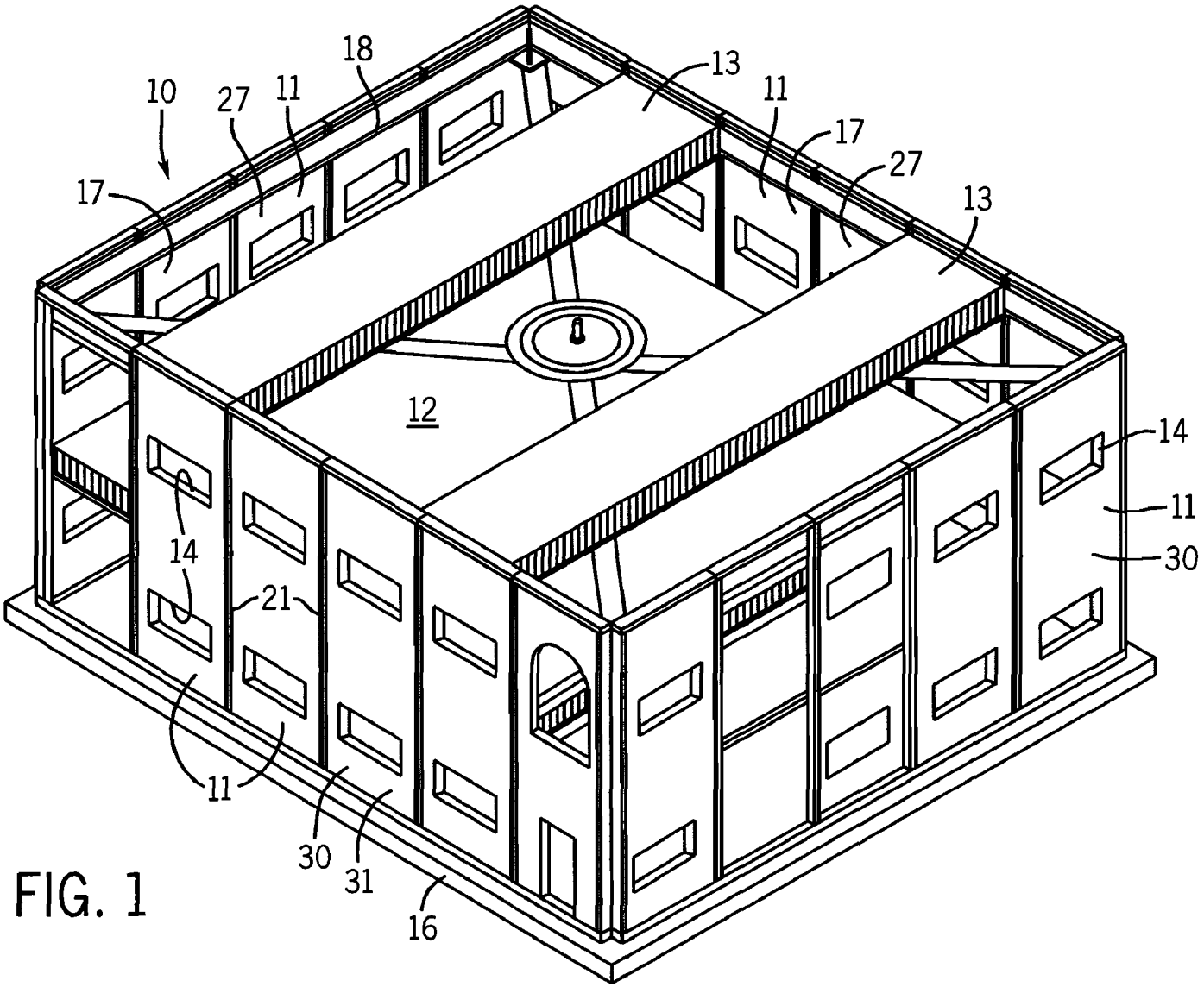
FIG. 1 is a perspective view of a two story commercial building utilizing a modular construction including wall panels of the subject invention.
Figure 2:
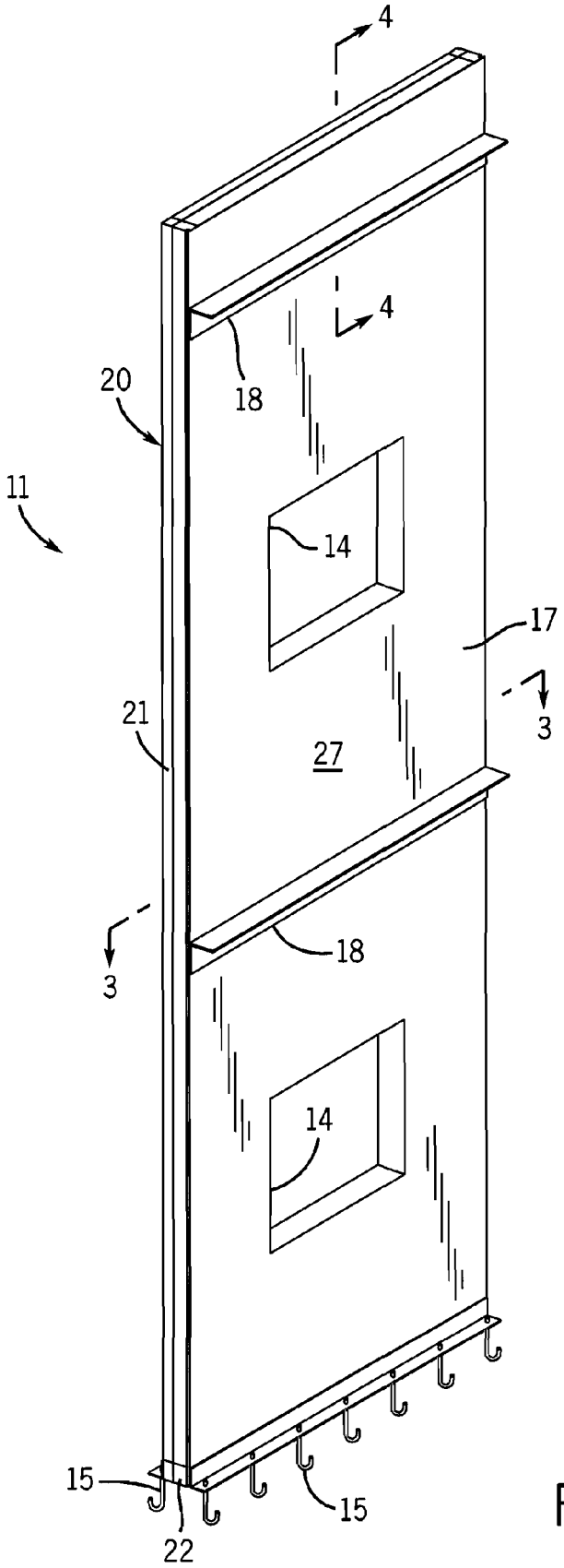
FIG. 2 is a perspective view of a wall panel of the subject invention used in the construction of the FIG. 1 building.

In FIG. 1, there are shown the components of a two story building 10 utilizing lightweight hollow core elements for the second floor 12 and roof 13, as described in my above identified co-pending patent applications, and the wall panels 11 which are the subject of the present invention. Each wall panel 1, for the building shown, is 8 ft. wide and 28 ft. long. As shown in FIG. 2, the wall panel 11 may be provided with through openings 14 for windows and/or doors, but the openings are of course optional. The bottom edge of the panel 11 is provided with a series of J-bolts 16 for anchoring in a concrete floor or footing 16 shown in FIG. 1. The FIG. 2 panel also has attached to its inner face 17 a pair of steel angle sections 18, which provide support for the FIG. 1 second floor 12 and roof 13.

Figure 3:
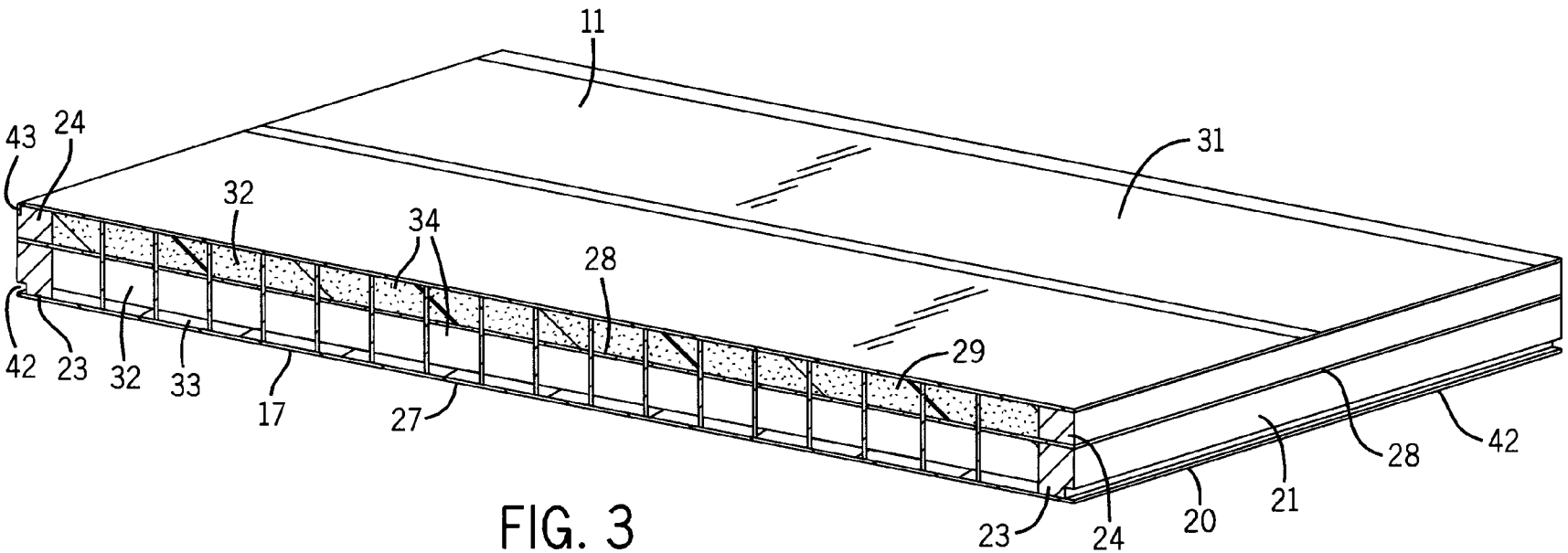
FIG. 3 is a horizontal sectional view taken on line 3-3 of FIG. 2.
Figure 4:
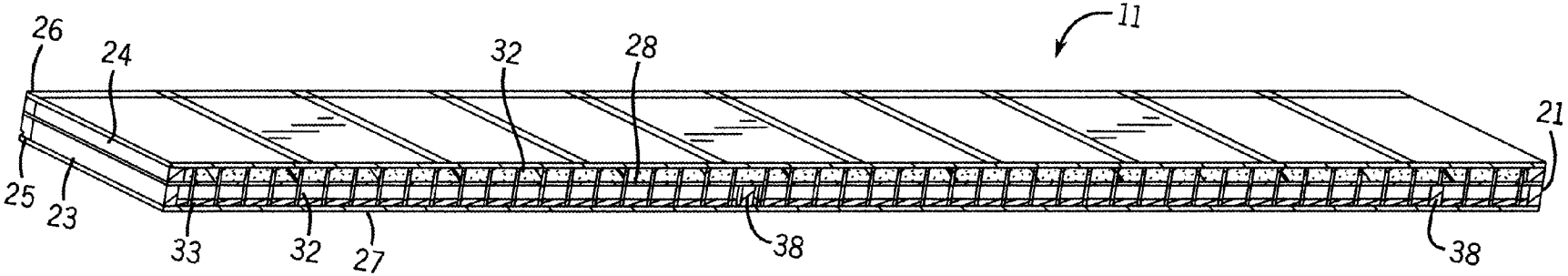
FIG. 4 is a vertical sectional view taken on line 4-4 of FIG. 2.

Each wall panel 11 is enclosed by a rectangular wooden frame 20. The frame includes vertical edge frame members 21 and horizontal upper and lower edge frame members 22. The ends of the horizontal members 22 may be joined to the ends of the vertical frame members 21 in any suitable manner, including adhesives, mechanical fasteners, or both. Referring particularly to FIG. 3, the vertical edge frame members 21 are of two-piece construction, including a front edge portion 23 and a rear edge portion 24. Similarly, as shown in FIG. 4, the horizontal edge frame members 22 are also of two-piece construction and include a front edge portion 25 and a rear edge portion 26.

The front inner face 17 of the panel 11 is covered with a thin steel sheet 27 which may be 0.060 in. thick (about 1.5 mm) and covers the entire inner front face including the face of the frame 20. The steel sheet 27 is bonded to the face of the frame 20 with a suitable adhesive, such as an epoxy.

The front edge portions 23 and 25 of the two-piece frame may be 3 in.×5 in. in cross section and the corresponding rear edge portions 24 and 26 may be 3 in.×3 in. in cross section. An interior steel skin sheet 28, of the same size (0.060 in.) and shape as the front steel skin sheet 27, is sandwiched between the front and rear portions of the two-piece frame members 21 and 22. The interior skin sheet 28 is secured by bonding with a suitable adhesive as described above. The outer or rear face 30 of the panel 11 is enclosed by an outer layer 31 of any suitable material, including another thin steel skin sheet, plywood, oriented strand board, or the like.

The interior of the wall panel 11 is filled substantially completely with open core elements 32 of the type made in accordance with the teachings of my above identified co-pending patent applications. Briefly, the open core element 32 is made from a plurality of fluted strips of a web material, such as paper, that are bonded together by interposed smooth unfluted webs. The open core elements 32 which are formed in a rectangular shape are sized to be fully enclosed by the wooden frame 20. The core elements are oriented such that the flutes are perpendicular to the plane of the frame and the skins sheets 27 and 28. Preferably, the open core elements 32 are also oriented, in use, with the smooth webs horizontally disposed.

In the embodiment shown, a thin layer of gypsum 33 fills a portion of the open core element 32 directly against the inside surface of the front skin sheet 27. The gypsum layer 33 is formed by methods which will be described hereinafter. Between the back face of the gypsum layer 33 and the interior steel skin sheet 28, the open core element 32 is left open. The open core element 32 between the other face of the interior steel skin sheet 28 and the outer layer 31 is filled with a closed cell foam material 29 for insulating purposes. This helps maintain the front skin sheet 27 and interior skin sheet 28 at roughly the same temperature, thereby limiting distortion of the skins resulting form thermal differential.

Figure 5:
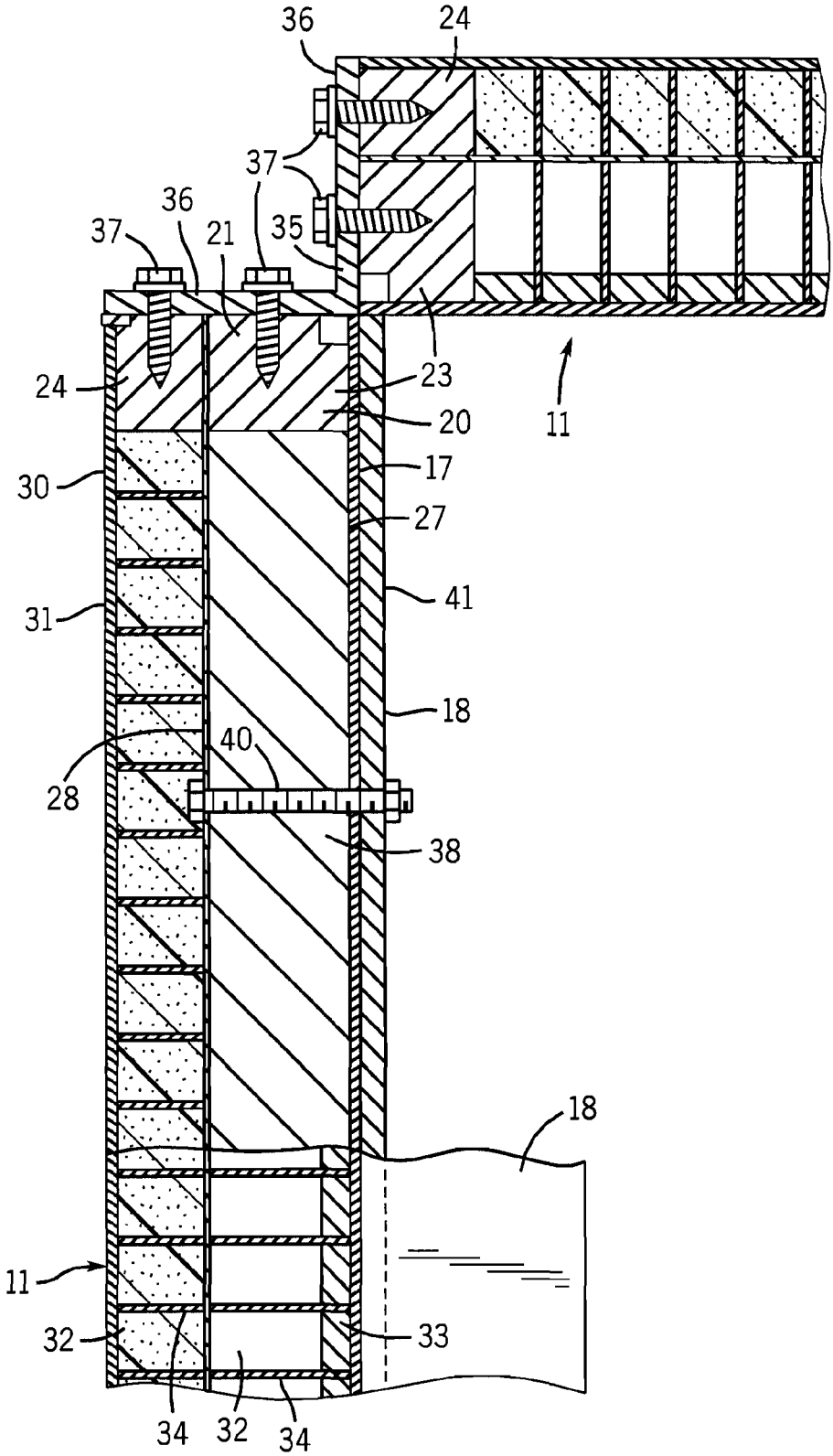
FIG. 5 is a horizontal sectional detail of the joint between two interconnected wall panels.

The sectional detail in FIG. 5 shows how two corner wall panels 11 are connected. A steel angle member 35 is positioned in the open corner and fastened by its flanges 36 to the outside faces of the adjoining vertical edge frame members 21. The angle member 35 may be suitably bored to receive lag screws 37 driven into the frame members 21.

The wall panel 11 also includes interior wood support members 38 to which the wall supporting angle sections 18 are attached. Each wooden support member 38 may conveniently comprise a 3 in.×5 in. piece that extends between and is attached to the front edge portion 23 of the vertical edge frame members 21. The floor and roof supporting angle sections 18 (FIG. 1) are attached to an interior support member 38 with bolts 40 that extend from the interior of the panel 11, through the interior steel skin sheet 28, the support member 38, the front steel skin sheet 27 and the vertical flange 41 of the angle member 18.

The vertical edge frame members 21 of the frame 20 run the full 28 ft. height of the panel. These vertical frame members provide structural column support for the floor and roof members, particularly in the panels away from the building corners. Because of the difficulty in obtaining one-piece 28 ft. members, shorter vertical edge frame members 21, suitably spliced, are preferable.

As may be seen in FIG. 3, the front edge portion 23 of the vertical edge frame members 21 are provided with corner notches 42. The front steel skin sheet 27 overlies the notches 42 and suitable sealing strips may be inserted therein as the panels are assembled edge-to-edge. In addition, one of the rear edge portions 24 of a vertical edge frame member 21 may also be provided with a sealing strip 43 that abuts the face of the vertical edge frame member of the next adjacent panel. The panels may be bonded together with a suitable adhesive or by mechanical fasteners.

Figure 6:
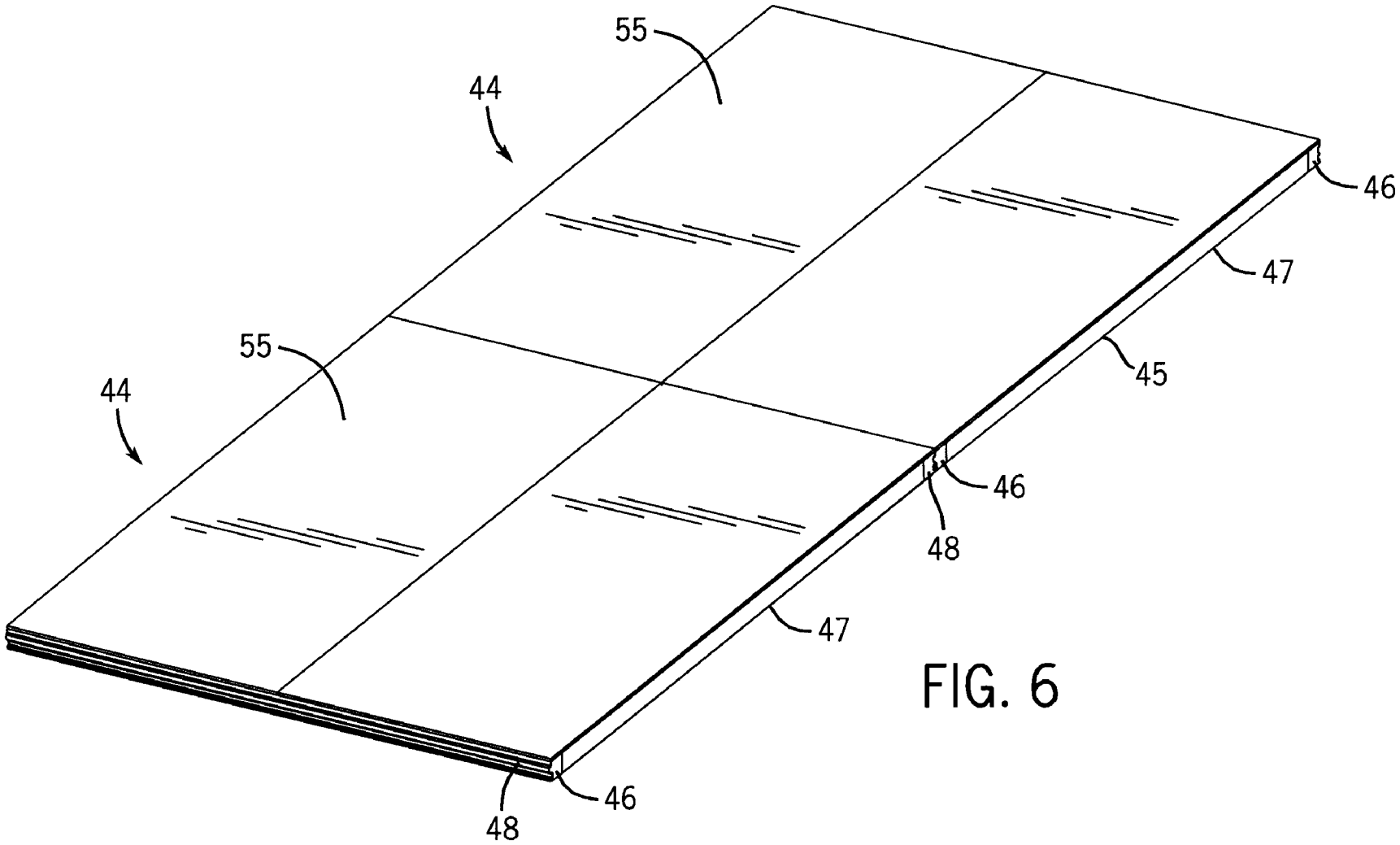
FIG. 6 is a perspective view of an arrangement of two interconnected wall panels made in accordance with another embodiment of the invention.
Figure 7:
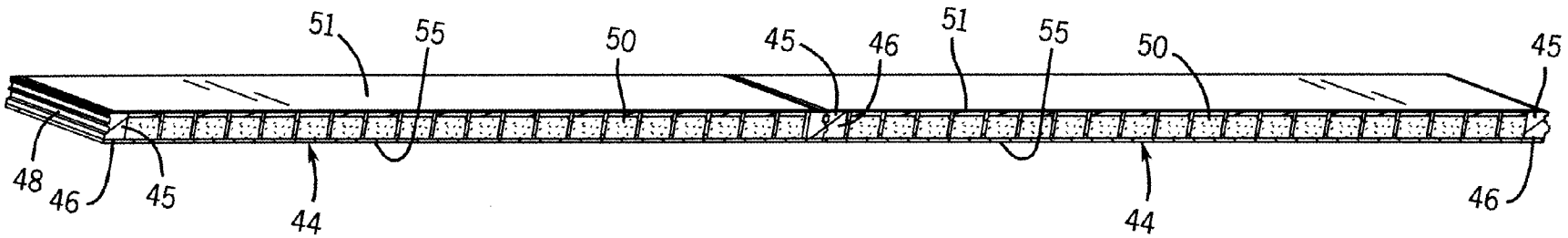
FIG. 7 is a horizontal sectional view taken on line 7-7 of FIG. 6.

FIG. 6 shows a pair of interconnected wall panels in accordance with another embodiment of the invention which are particularly suitable for residential construction. The panels may each be 8 ft. high and 10 ft. long. Each panel is closed on its edges by a frame 45 that includes vertical edge frame members 46 and horizontal top and bottom edge frame members 47. The vertical edge frame members 46 are provided with complimentary tongue-and-groove profiles 48 to help close and strengthen the glue joint therebetween when assembled edge-to-edge.

The interior of the frame 45 is filled with an open core element, as described with respect to the preceding embodiments. Thus, the open core element 50 may be made in accordance with the teaching of my above identified pending patent applications. The frame 45 is covered on an inside face with a two-part layer 51 comprising an inner vapor barrier 52 and a paper cover sheet 53. The open core element 50 just inside the vapor barrier 52 is filled with a gypsum layer 54. If the overall wall panel thickness is about 4 in., the gypsum layer 54 may be 1 in. thick. The remainder of the open core element 50, from the inner face of the gypsum layer to an outside cover layer 55, is filled with a closed cell foam 56. The outside cover layer may be plywood or oriented strand board to which conventional siding may be applied.

Figure 8:
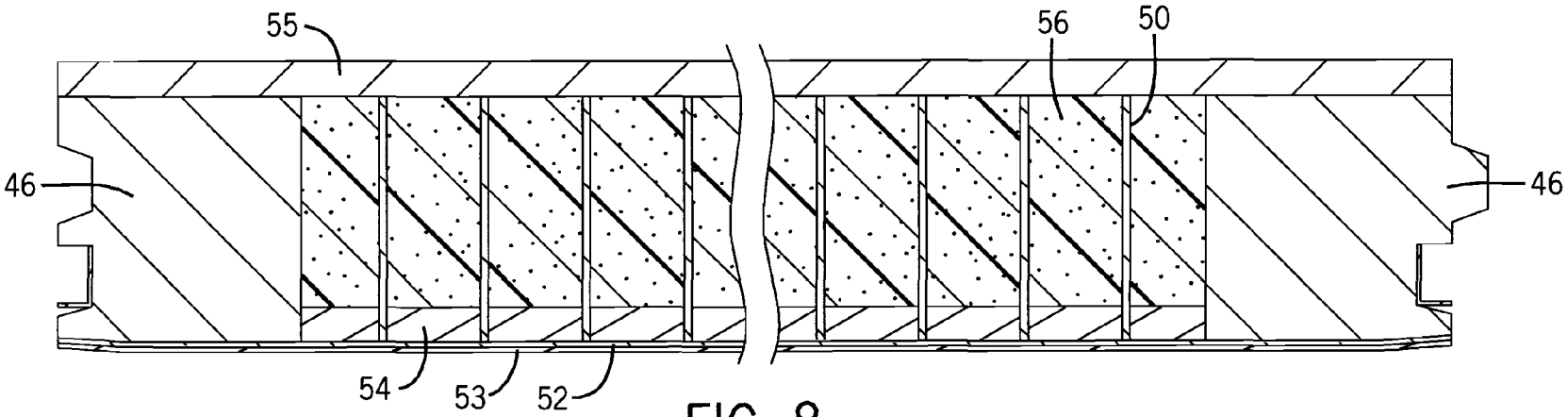
FIG. 8 is a sectional detail of one embodiment of the wall panel of FIG. 6.
Figure 9:
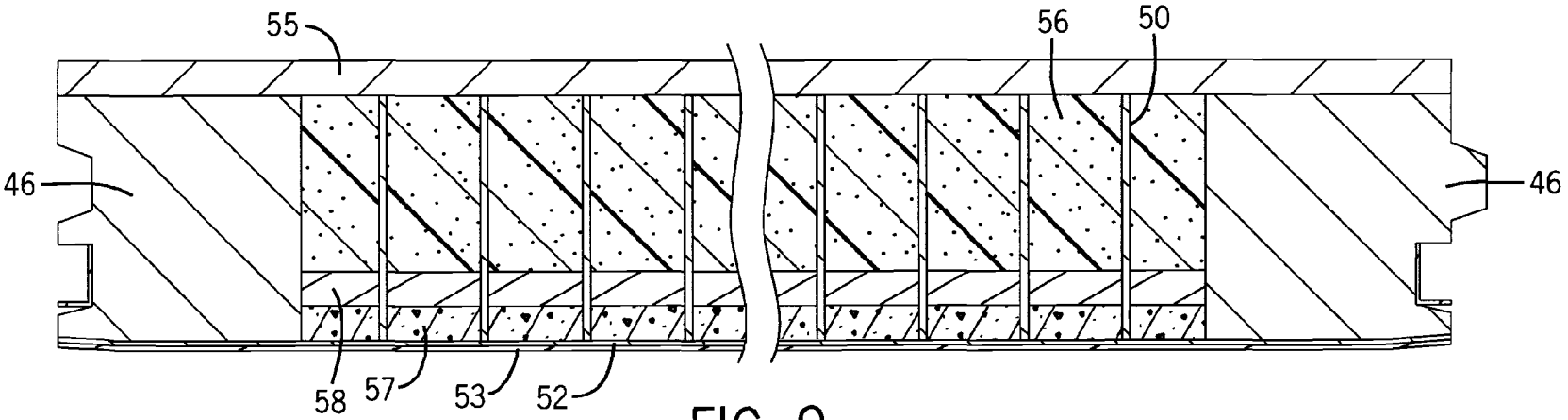
FIG. 9 is a sectional detail of another embodiment of the wall panel shown in FIG. 6.

A variation in the wall panel 44 of FIG. 8 is shown in FIG. 9. The FIG. 9 construction is identical to the FIG. 8 panel, except, in the FIG. 9 construction, a thin concrete layer 57 is formed on the inside face against the two-part cover layer 51. The concrete layer provides additional load bearing support, particularly in the vertical direction. Abutting the inside face of the concrete layer 57 is a gypsum layer 58 which is essentially the same as the gypsum layer 54 in the FIG. 8 embodiment, except for its location. In either case, the gypsum layer 54 or 58 provides a protective fire wall, as well as additional structural support, in the same manner as conventional gypsum wallboard.

Figure 10:
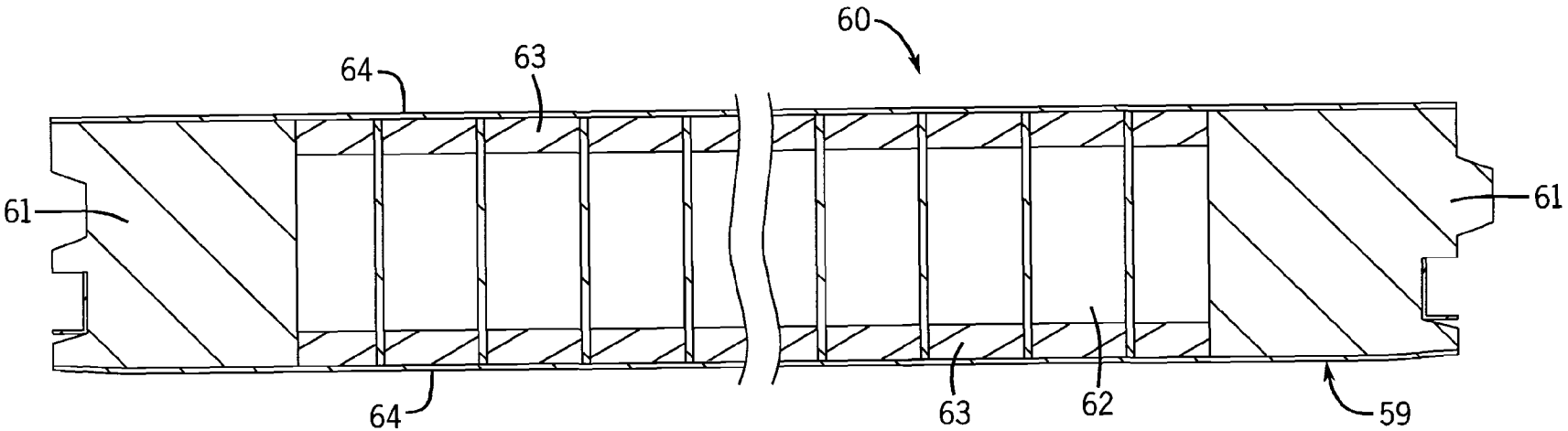
FIG. 10 is a horizontal sectional detail of a further embodiment of the wall panel of FIG. 6.

In FIG. 10, there is shown a sectional detail of a wall panel 60 that is particularly well suited for interior residential construction. The interior wall panel 60 has a wooden frame that comprises vertical edge frame members 61 that may be identical to the edge frame members of the FIG. 8 and FIG. 9 embodiments. Horizontal edge frame members, not shown, may also be identical to those previously described. The frame contains an open core element 62 which is filled at opposite panel faces with identical gypsum layers 63, each of which is covered on the outside face by a paper layer 64. The paper layer 64 extend over and is bonded to the opposite faces of the panel frame 59. The open core element 62 between the gypsum layers 63 may be left open or filled with a closed cell foam material. The thickness of the vertical edge frame members 61 may be made just slightly less than the thickness of the open core element 62, to provide a slight edge relief along the panel edges which would accommodate conventional drywall taping. In addition, plastic wire chase tubes may be run in the interior open core element between the gypsum layers so the fire barrier would not be broken. Junction boxes may be pre-installed and a ground wire or wire pull also put in place.

A convenient, efficient and effective method of providing a wall panel with one or two gypsum layers, which is applicable to the FIG. 10 embodiment, as well as other described embodiments, will now be described with respect to FIG. 10. First, a hollow core element 62 is made in a rectangular shape sized to fit closely within the frame 59. As described above, the open core elements 62 are disposed with the flutes extending perpendicular to the panel faces. The frame 59 is covered on one face by a paper layer 64 and supported on a horizontal surface. A liquid gypsum mixture is poured into the frame from the open backside to a selected depth, e.g. ¾ in. (about 19 mm). The rectangular core panel is then pressed into the frame and through the liquid gypsum all the way to the paper layer 64 on the supporting surface. The liquid gypsum is forced into the face portion of the open core panel to the depth selected. The liquid gypsum is then allowed to set sufficiently to form a self-supporting gypsum layer.

While the panel is intended for exterior building wall construction, the inside of the paper layer 64 is provided with an impervious barrier layer in the manner described previously with respect to other embodiments. To form the gypsum layer 63 in the other face of the panel, a number of alternate methods may be used. Preferably, the open core element, with the set first gypsum layer 63 in place, is removed from the frame, inverted and reinserted into the frame after a second layer of liquid gypsum has been poured therein. The core element is then pressed into the second liquid gypsum layer, in the manner previously described, and the gypsum layer is allowed to set. Alternately, a second layer of liquid gypsum may be filled into the frame after the first gypsum layer has set, the frame immediately inverted with a paper covered supporting layer held on to the back face, and the liquid gypsum permitted to settle into the position of the second layer where it is held until the gypsum sets. It may also be possible to provide the second layer by inverting the entire frame containing the core element and the first set gypsum layer and pressing the entire assembly into a thin pool of liquid gypsum to the selected depth.

To form the composite two-layer arrangement of FIG. 9, the wooden frame 45 would first be filled with a layer of liquid concrete (Portland cement and sand) to a desired depth, e.g. ½ in. (13 mm), and a layer of liquid gypsum poured immediately a top the liquid concrete layer to a selected depth, ¾ in. (19 mm). The open core element 50 is then pressed downwardly through the gypsum layer and then the concrete layer until it reaches the horizontally supported front face of the frame covered with a suitable two-ply vapor barrier/paper cover layer.

Figure 11:
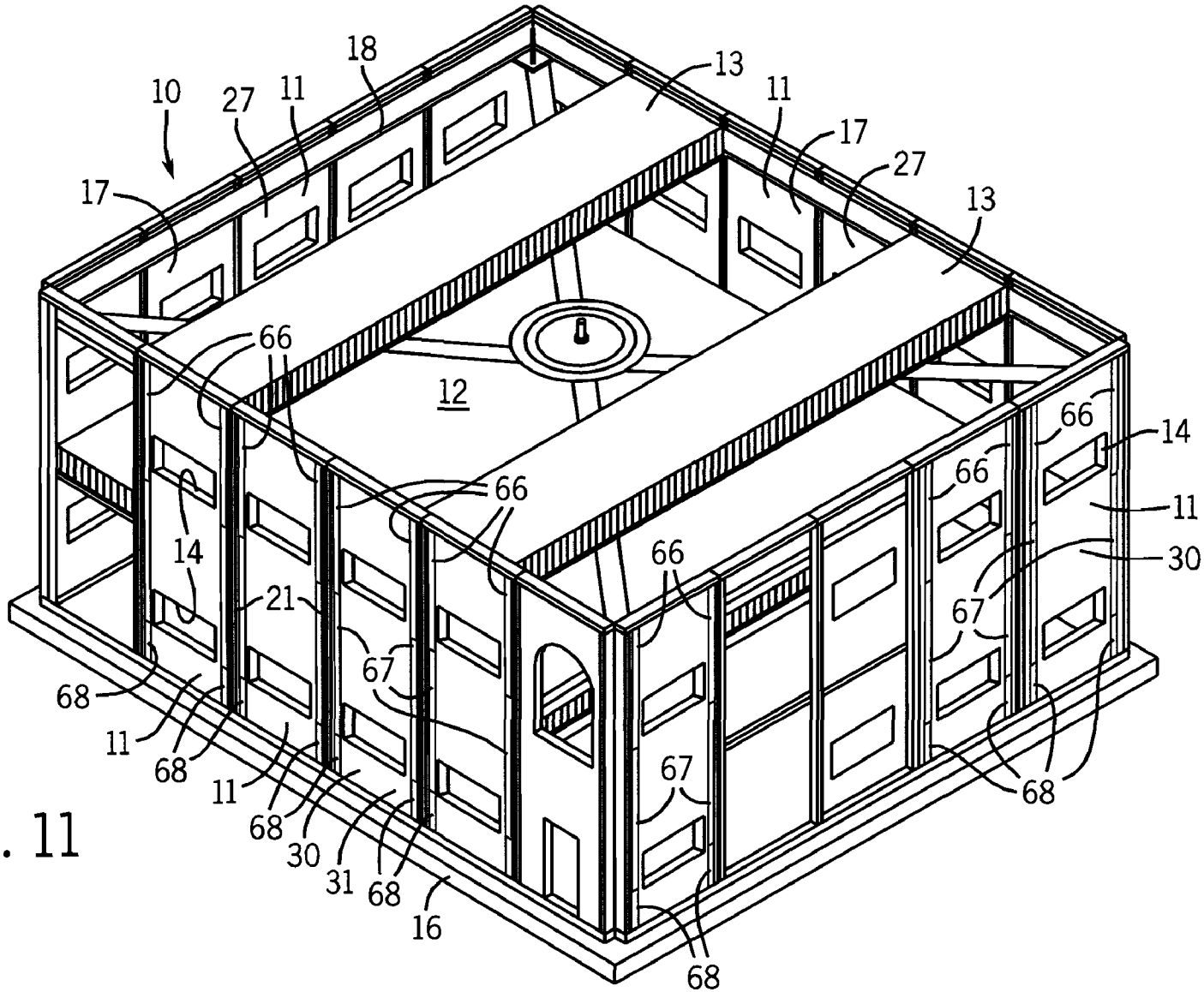
FIG. 11 is a perspective view of a two story building, similar to FIG. 1, but showing the use of vertical load bearing strips applied to the outer panel face.
Figure 12:
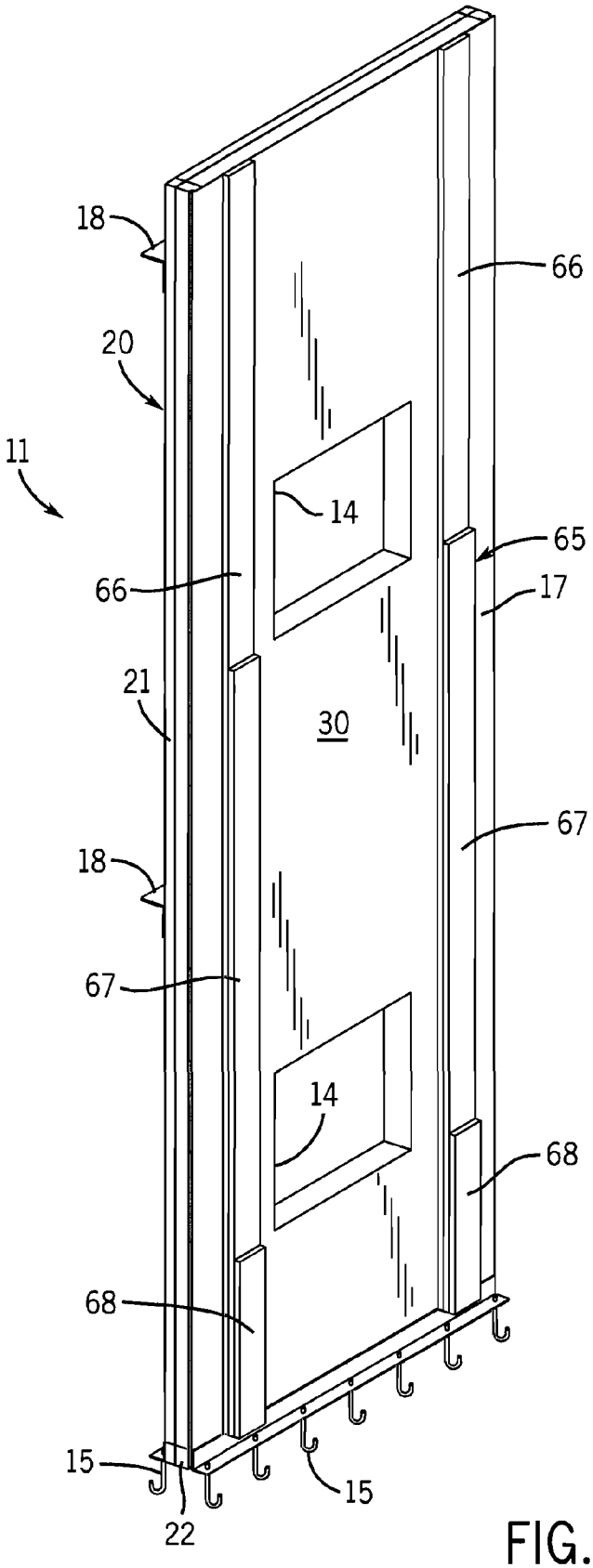
FIG. 12 is a perspective view of a wall panel taken from the outside and showing details of the reinforcing strips shown in FIG. 11.

In FIGS. 11 and 12, there is shown a modification to the building wall panels shown in FIGS. 1 and 2 and previously described. The need to provide openings in the wall panels for windows, doors and the like, inherently results in a decrease in panel strength, particularly vertical load bearing strength. In accordance with the embodiment shown in FIGS. 11 and 12, the wall panels 11 are reinforced to compensate for the loss in strength resulting from the through openings 14 for windows and doors.

When the panels 11 are used in the construction of a multistory building 10, a plurality of thin steel reinforcing strips 65 are fastened to the outer face 30 of the panels. For a two story building, as shown, two parallel sets of strips 65 are applied to the wall panel 11 between the vertical edge frame members 21 and the openings 14. Each set of reinforcing strips includes three strips of progressively shortened length fixed atop one another. The first strip 66 of each set runs the full height of the panel between the horizontal upper and lower edge frame members 22. The second strip 67 is shorter in length than the first and extends from the lower edge of the frame to the second story opening 14. Similarly, the third strip 68 extends vertically from the lower edge frame member to the first story opening 14. As shown, the second and third strips 67 and 68 terminate near the lower edges of the respective openings 14, but they may be extended or reduced somewhat in length as desired or needed.

The steel strips 65 may have a gauge or thickness the same as the front steel skin sheet 27 or the interior steel skin sheet 28. However, the gauge of the steel reinforcing strips 65 may be varied considerably, but a thickness range of from 0.040 to 0.080 inch is presently preferred.

The strips 65 may be secured to the outer rear panel face 30 in any convenient manner. However, adhesive attachment using, preferably, epoxies is preferred. In addition, reinforcing strips of other materials, such as aluminum, may be used.

Although the reinforcing strips 65, shown in FIGS. 11 and 12 are of equal widths, the widths may vary from one strip to another. For example, the longest first strip 66 may have the greatest width and widths of the subsequent second and third strips may be progressively narrowed in width. Preferably, the strips are about 12 inches in width. For buildings having three or more stories, reinforcing strips are applied using the same strategy described for the two story building panels of FIGS. 11 and 12.

Figure 13:
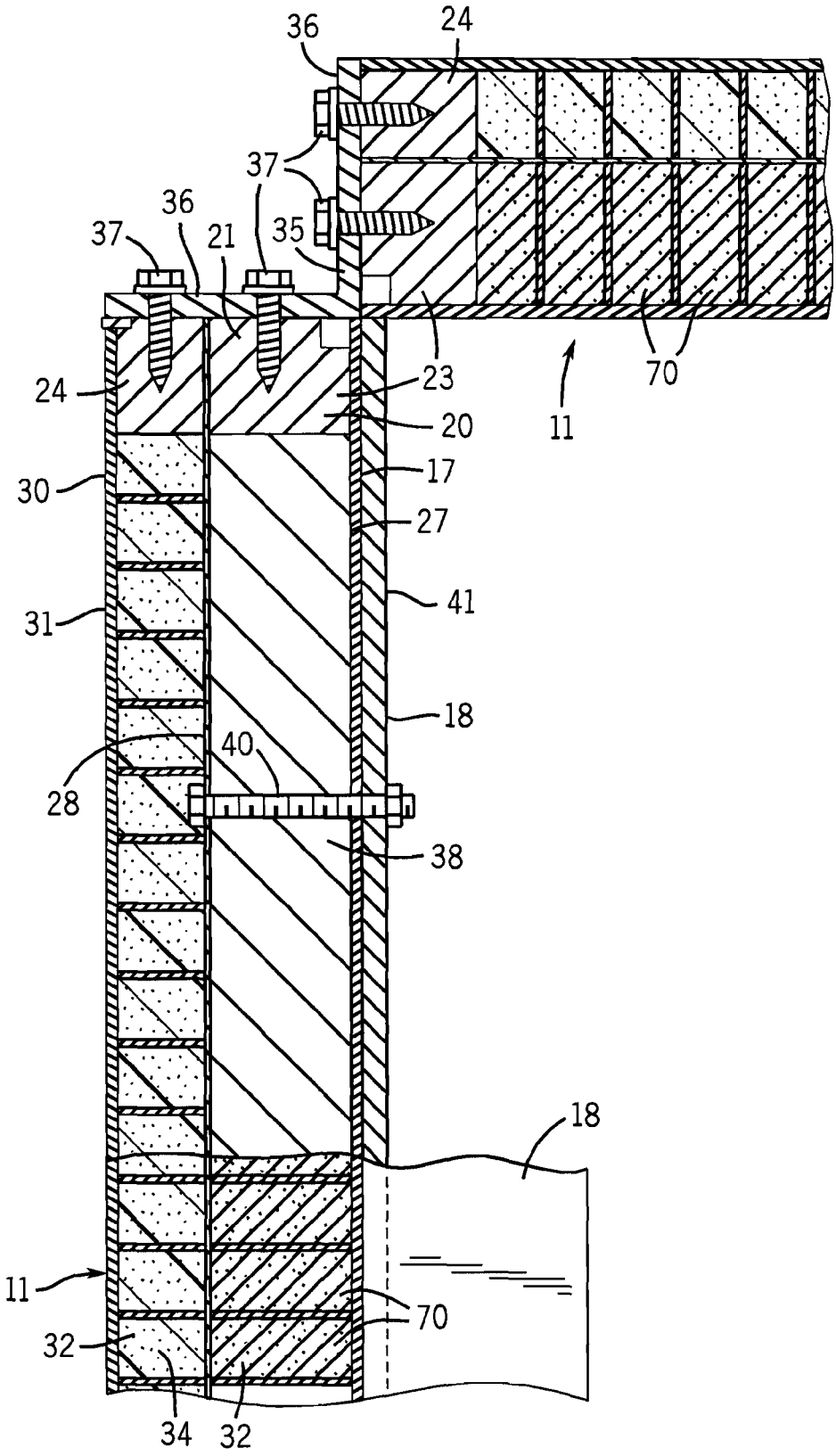
FIG. 13 is a horizontal sectional detail similar to FIG. 5, but showing a variation in the material filling portion of the open core element.

Referring to FIG. 13, the sectional view of interconnected wall panels 11 is similar to the section shown in FIG. 5. However, the gypsum layer 33 in the FIG. 5 embodiment has been eliminated and that portion of the open core element 32 between the front steel skin sheet 27 and the interior steel skin sheet 28 is filled completely with a dry sand 70. The sand adds mass and thus stability to the structure. More importantly, however, the sand provides an especially effective sound-deadening layer to the wall panels and to the overall building.

FIG. 13 wall panels may otherwise be identical to the FIG. 5 panels. In this regard, the outer open core element 32, between the interior skin sheet 28 and the outer layer 31, may be filled with a closed cell foam material.

I claim:

1. A structural load-bearing exterior building wall panel comprising:

a rectangular peripheral outer frame including vertical edge frame members and upper and lower horizontal edge frame members joined to the ends of the vertical edge frame members;

the frame enclosing an open core element comprising a plurality of fluted strips of a web material bonded together and having flutes oriented perpendicular to the plane of the frame and defining with the frame parallel inner and outer panel faces;

an interior steel skin sheet attached to and covering the inner panel face;

an outer layer attached to and covering the outer panel face;

through openings in the panel extending between and through the interior steel skin sheet and the outer layer;

a plurality of reinforcing strips attached to the outer layer and extending vertically between the upper and lower edge frame members; and, the reinforcing strips placed flush atop the outer surface of the outer layer, at least partially overlying and secured to one another, and positioned laterally adjacent the openings.

2. The wall panel as set forth in claim 1 and further comprising:

an intermediate steel skin sheet disposed between the inner and outer panel faces, said intermediate sheet, lying parallel to said panel faces and attached at its peripheral edge to the frame;

said intermediate skin sheet dividing the open core element into inner and outer core elements; and closed cell foam filing at least one of the open core elements.

3. The wall panel as set forth in claim 1 wherein the strips comprise a first strip extending substantially the full distance between the upper and lower edge frame members and at least one additional strip extending from the lower edge frame member to a first opening thereabove.

4. The wall panel as set forth in claim 3 wherein the panel includes at least two vertically spaced openings and further comprising a second additional strip between said first strip and said one additional strip, said second additional strip extending from the lower edge frame member to the upper of said two openings.

5. An exterior building wall panel comprising:

a rectangular peripheral outer frame including vertical edge frame members and upper and lower horizontal edge frame members joined to the ends of the vertical edge frame members;

the frame enclosing an open core element comprising a plurality of fluted strips of a web material bonded together and having flutes oriented perpendicular to the plane of the frame and defining with the frame parallel inner and outer panel faces;

an interior steel skin sheet attached to and covering the inner panel face;

an outer layer attached to and covering the outer panel face;

a plurality of vertically spaced through openings extending between and through the interior steel skin sheet and the outer layer;

a plurality of reinforcing strips attached flush to the outer layer and extending vertically upwardly from lower ends at the lower edge frame member;

the strips placed flush atop one another with a first of said strips attached directly to the outer layer and extending from the lower end to the upper edge frame member; and, each subsequently attached strip having a length less than the strip that precedes it.

6. The building wall panel as set forth in claim 5 wherein the strips comprise steel sheet material having a thickness in the range of 0.040 to 0.080 inch.

7. The building wall panel as set forth in claim 5 wherein the strips are of the same width.

8. The building wall panel as set forth in claim 5 wherein each subsequently attached strip has a width less than the strip that precedes it.

9. The building wall panel as set forth in claim 5 wherein the upper ends of subsequently attached strips extend in sequence from the uppermost to the lowermost of said openings.

10. A structural load-bearing exterior building wall panel as set forth in claim 1 comprising:

an intermediate steel skin sheet disposed between the inner and outer panel faces, said intermediate skin sheet, lying parallel to said panel faces and attached at its peripheral edge to the frame;

said intermediate skin sheet dividing the open core element into inner and outer core elements; and, a dry sand layer filling the inner core element.

11. The wall panel as set forth in claim 10 wherein the outer core element is filled with a closed cell foam.

12. The building wall panel as set forth in claim 5 comprising a plurality of reinforcing strips laterally adjacent each side of the through openings.

* * * * *